United States Patent [19]

Nguyen et al.

[11] Patent Number: 5,069,771

[45] Date of Patent: Dec. 3, 1991

[54] MOLTEN SALT ELECTROLYSIS WITH NON-CONSUMABLE ANODE

[75] Inventors: Thinh Nguyen, Onex; Adbelkrim Lazouni, Geneva; Kim S. Doan, Onex, all of Switzerland

[73] Assignee: Moltech Invent S.A., Luxembourg

[21] Appl. No.: 350,475

[22] PCT Filed: Aug. 30, 1988

[86] PCT No.: PCT/EP88/00788

§ 371 Date: Apr. 28, 1989

§ 102(e) Date: Apr. 28, 1989

[87] PCT Pub. No.: WO89/01994

PCT Pub. Date: Mar. 9, 1989

[30] Foreign Application Priority Data

Sep. 2, 1987 [AT] Austria ..... 87810503

[51] Int. Cl.[5] ..... C25B 11/04; C25B 11/00; C25C 3/06

[52] U.S. Cl. ..... 204/292; 204/67; 204/242; 204/290 R

[58] Field of Search ..... 204/67, 290 R, 157.64; 252/530

[56] References Cited

U.S. PATENT DOCUMENTS

| | | | |
|---|---|---|---|
| 4,024,294 | 5/1977 | Rairden, III | 427/42 |
| 4,374,050 | 2/1983 | Ray | 252/519 |
| 4,374,761 | 2/1983 | Ray | 252/519 |
| 4,399,008 | 8/1983 | Ray | 204/67 |
| 4,478,693 | 10/1984 | Ray | 204/64 |
| 4,614,569 | 9/1986 | Duruz | 204/67 |
| 4,620,905 | 10/1986 | Tarcy | 204/64 |

FOREIGN PATENT DOCUMENTS

| | | |
|---|---|---|
| 0114085 | 7/1984 | European Pat. Off. . |
| 0257708 | 3/1988 | European Pat. Off. . |
| WO81/02027 | 7/1981 | PCT Int'l Appl. . |

OTHER PUBLICATIONS

Chemical Abstracts, vol. 103, 1985, p. 226, Abstract #9850e.

*Primary Examiner*—John F. Niebling
*Assistant Examiner*—Caroline Koestner
*Attorney, Agent, or Firm*—John J. Freer

[57] ABSTRACT

A method of electrowinning a metal by electrolysis of a melt containing a dissolved species of the metal to be won using a non-consumable anode having a metal, alloy or cermet substrate and an operative anode surface which is a protective surface coating of cerium oxyfluoride preserved by maintaining in the melt a suitable concentration of cerium, is characterized by using an anode provided with an electronically conductive oxygen barrier on the surface of the metal, alloy or cermet substrate. The barrier layer may be a chromium oxide film on a chromium-containing alloy substrate. Preferably the barrier layer carries a ceramic oxide layer, e.g. of stabilized copper oxide which acts as anchorage for the cerium oxyfluoride.

13 Claims, No Drawings

MOLTEN SALT ELECTROLYSIS WITH NON-CONSUMABLE ANODE

FIELD OF INVENTION

The invention relates to methods of electrowinning metals by electrolysis of a melt containing a dissolved species of the metal to be won using an anode immersed in the melt wherein the anode has a metal, alloy or cermet substrate and an operative anode surface which is a protective surface coating containing a compound of a metal less noble than the metal to be electrowon, the protective coating being preserved by maintaining in the melt a suitable concentration of a species of this less noble metal. The invention further relates to non-consumable anodes for the electrowinning of metals such as aluminum by molten salt electrolysis, and to methods of manufacturing such anodes as well as molten salt electrolysis cells incorporating them.

BACKGROUND OF INVENTION

The electrowinning method set out above has been described in U.S. Pat. No. 4,614,569 and potentially has very significant advantages. Usually the protective anode coating comprises a fluorine-containing oxycompound of cerium (referred to as "cerium oxyfluoride") alone or in combination with additives such as compounds of tantalum, niobium, yttrium, lanthanum, praesodymium and other rare earth elements, this coating being maintained by the addition of cerium and possibly other elements to the electrolyte. The electrolyte can be molten cryolite containing dissolved alumina, i.e. for the production of aluminum.

To date, however, there remain problems with the anode substrate. When this is a ceramic, the conductivity may be low. When the substrate is a metal, alloy or cermet, it may be subject to oxidation leading to a reduced life of the anode, despite the excellent protective effect of the cerium oxyfluoride coating which protects the substrate from direct attack by the corrosive electrolyte.

A promising solution to these problems has been the use of a ceramic/metal composite material of at least one ceramic phase and at least one metallic phase, comprising mixed oxides of cerium with aluminum, nickel, iron and/or copper in the form of a skeleton of interconnected ceramic oxide grains which skeleton is interwoven with a continuous metallic network of an alloy or intermetallic compound of cerium with aluminum, nickel, iron and/or copper, as described in EP-A-O 257 708. When used as electrode substrates, these materials have promise, particularly those based on cerium and aluminum because even if they corrode, this does not lead to corrosion products that contaminate the electrowon aluminum. Nevertheless corrosion of the substrate remains a problem.

Generally speaking, materials used as non-consumable anodes in molten electrolytes must have a good stability in an oxidising atmosphere, good mechanical properties, good electrical conductivity and be able to operate for prolonged periods of time under polarising conditions. At the same time, materials used on an industrial scale should be such that their welding and machining do not present unsurmountable problems to the practitioner. It is well known that ceramic materials have good chemical corrosion properties. However, their low electrical conductivity and difficulties of making mechanical and electrical contact as well as difficulties in shaping and machining these materials seriously limit their use.

In an attempt to resolve well known difficulties with conductivity and machining of ceramic materials, the use of cermets was proposed. Cermets may be obtained by pressing and sintering mixtures of ceramic powders with metal powders. Cermets with good stability, good electrical conductivity and good mechanical properties, however, are difficult to make and their production on an industrial scale is problematic. Also the chemical incompatibilities of ceramics with metals at high temperatures still present problems. Composite materials consisting of a metallic core inserted into a premachined ceramic structure, or a metallic structure coated with a ceramic layer have also been proposed. Cermets have been proposed as non-consumable anodes for molten salt electrolysis but to date problems with these materials have not been solved.

U.S. Pat. No. 4,374,050 discloses inert electrodes for aluminum production fabricated from at least two metals or metal compounds to provide a combination metal compound. For example, an alloy of two or more metals can be surface oxidised to form a compounded oxide of the metals at the surface on an unoxidised alloy substrate. U.S. Pat. No. 4,374,761 discloses similar compositions further comprising a dispersed metal powder in an attempt to improve conductivity. U.S. Pat. Nos. 4,399,008 and 4,478,693 provide various combinations of metal oxide compositions which may be applied as a preformed oxide composition on a metal substrate by cladding or plasma spraying. The application of oxides by these techniques, however, is known to involve difficulties. Finally, U.S. Pat. No. 4,620,905 describes an oxidised alloy electrode based on tin or copper with nickel, iron, silver, zinc, magnesium, aluminum or yttrium, either as a cermet or partially oxidised at its surface. Such partially oxidised alloys suffer serious disadvantages in that the oxide layers formed are far too porous to oxygen, and not sufficently stable in corrosive environments. In addition, it has been observed that at high temperatures the partially oxidised structures continue to oxidize and this uncontrolled oxidation causes subsequent segregation of the metal and/or oxide layer. In addition, the machining of ceramics and achieving a good mechanical and electrical contact with such materials involves problems which are difficult to solve. Adherence at the ceramic-metal interfaces is particularly difficult to achieve and this very problem has hampered use of such simple composites. Finally, these materials as such have not proven satisfactory as substrates for the cerium oxyfluoride coatings in the aforementioned process.

DISCLOSURE OF THE INVENTION

It is an object of the present invention to improve the specified method for electrowinning aluminum and other metals from molten salts containing compounds (eg oxides) of the metals to be won, by improving the protection of the metal, alloy or cermet substrate.

It is a further object of the invention to provide an improved electrochemical cell for electrowinning aluminum and other metals from their oxides with one or more anodes having a metal, alloy or cermet substrate with an in-situ deposited surface protective coating.

Still another object of the invention is to provide a method of manufacturing composite anode structures having a good chemical stability at high temperatures in oxidising and/or corrosive environments; a good electrochemical stability at high temperatures under anodic polarisation conditions; a low electrical resistance; a good chemical compatibility and adherence between the ceramic and metal parts; a good mechinability; a low cost of materials and manufacture; and a facility of scaling up to industrial sizes.

According to a main aspect of the invention, the electrowinning method using an anode with an in-situ maintained protective coating is improved by providing an anode comprising an electronically conductive oxygen barrier layer on the surface of the metal, alloy or cermet substrate. preferably, the anode further comprises an oxide ceramic layer between the protective coating and the oxygen barrier layer, this oxide ceramic layer serving as anchorage for the protective coating.

The barrier layer acts to prevent the penetration of gaseous or ionic oxygen to the substrate, and must have good electronic conductivity while also assisting anchorage of the protective cerium oxyfluoride coating or of a ceramic coating which in turn supports the protective cerium oxyfluoride coating. The oxygen barrier layer may be a chromium oxide containing layer; a layer containing at least one of platinum, palladium and gold; or alloys such as platinum-zirconium and nickel-aluminum alloys. Also, it may be an integral oxide film composed of components of the metal, alloy or cermet substrate, or a surface layer applied to the metal, alloy or cermet substrate.

In one method of manufacturing the non-consumable anode, an oxygen barrier layer containing chromium oxide is produced by a) providing on the metal substrate a surface layer containing chromium metal and/or chromium oxide; b) applying to said surface layer an oxide ceramic coating or a precursor of an oxide ceramic coating; and c) optionally heating in an oxidising atmosphere to convert chromium metal in said surface layer to chromium oxide and/or to convert the ceramic oxide precursor into the ceramic oxide coating. One advantageous method of manufacture comprises the in-situ oxidation of a surface layer of a chromium-containing alloy substrate by heating in an oxidising atmosphere after application to said surface layer of the oxide ceramic coating or a precursor of the oxide ceramic coating.

Alternative methods involve depositing the barrier layer by torch spraying, plasma spraying, electron beam evaporation, electroplating or other techniques usually followed by an annealing and/or oxidising treatment which may also serve to interdiffuse components of the barrier layer and the substrate, also possibly components of an outer ceramic coating.

The composite anode structure typically has a metallic core of a high temperature resistant alloy for example chromium with nickel, cobalt or iron and optional components, with a ceramic coating which may be an oxidised copper alloy. In addition to 55-90%, usually 55-85%, by weight of the basic component nickel, cobalt and/or iron (for example 70-80% of nickel with 6-10% iron, or 75-85% iron), the core alloy contains 10 to 30% (preferably 15 to 30%) by weight of chromium, but is essentially devoid of copper or comparable metals which oxidise easily, i.e. contains no more than 1% by weight of such components, usually 0.5% or less. Other minor components such as aluminum, hafnium, molybdenum, niobium, silicon, tantalum, titanium, tungsten, vanadium, yttrium and zirconium can be added into the core alloy up to a total content of 15% by weight in order to improve its oxidation resistance at high temperatures. Other elements, such as carbon and boron, may also be present in trace quantities, usually well less than 0.5%. Commercially available so-called superalloys or refractory alloys such as INCONEL™ HASTALLO™, HAYNES™, UDIMET™, NIMONIC™, INCOLOY™, as well as many variants thereof may conveniently be used for the core.

In some embodiments, there is a ceramic coating comprising an oxidised alloy of 15 to 75% by weight copper, 25 to 85% by weight of nickel and/or manganese, up to 5% by weight of lithium, calcium, aluminum, magnesium or iron and up to 30% by weight of platinum, gold and/or palladium in which the copper is fully oxidised and at least part of the nickel and/or manganese is oxidised in solid solution with the copper oxide, and the substrate comprises 15-30% by weight of chromium, 55-85% of nickel, cobalt and/or iron and up to 15% by weight of aluminum, hafnium, molybdenum, niobium, silicon, tantalum, titanium, tungsten, vanadium, Yttrium and zirconium, the interface of the substrate with the surface ceramic coating having an oxygen-barrier layer comprising chromium oxide.

The metallic coating or envelope may be made of a copper based alloy and is typically 0.1 to 2 mm thick. The copper alloy typically contains 20 to 60% by weight of copper and 40-80% by weight of another component of which at least 15-20% forms a solid solution with copper oxide. Cu-Ni or Cu-Mn alloys are typical examples of this class of alloys. Some commercial Cu-Ni alloys such as varieties of MONEL™ or CONSTANTAN™ may be used.

Further embodiments of the ceramic coating which in use serves as anchorage for the in-situ maintained protective coating of eg cerium oxyfluoride include nickel ferrite; copper oxide and nickel ferrite; doped, non-stoichiometric and partially substituted ceramic oxide spinels containing combinations of divalent nickel, cobalt, magnesium, manganese, copper and zinc with divalent/trivalent nickel, cobalt, manganese and/or iron, and optionally dopants selected from $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$ (see U.S. Pat. No. 4 552 630); as well as coatings based on rare earth oxides and oxyfluorides, in particular pre-applied cerium oxyfluoride alone or in combination with other components.

The alloy core resists oxidation in oxidising conditions at temperatures up to 1100° C. by the formation of an oxygen impermeable refractory oxide layer at the interface. This oxygen-impermeable layer is advantageously obtained by in-situ oxidation of chromium contained in the substrate alloy forming a thin film of chromium oxide, or a mixed oxide of chromium and other minor components of the alloys.

Alternatively, a chromium oxide barrier layer could be applied e.g. by plasma spraying on to a nickel, cobalt or iron-based alloy base, or other types of essentially oxygen-impermeable electronically-conductive barrier layers could be provided, such as a platinum/zirconium layer or a nickel-aluminum layer, mixed-oxide layers especially based on chromium oxide, alloys and intermetallics especially those containing platinum or another precious metal, or non-oxide ceramics such as carbides. preferably, however, barrier layers containing chromium oxide, alone or with another oxide, will be formed by in-situ oxidation of a suitable alloy substrate but, especially for other compositions, different methods are also available including torch spraying, plasma spraying, cathodic sputtering, electron beam evaporation and electroplating followed, as appropriate, by an oxidising treatment before or after the coating is applied as a metal, layers of different metals or as an alloy.

The metallic composite structure may be of any suitable geometry and form. Shapes of the structure may be produced by machining, extrusion, cladding or welding. For the welding process, the supplied metal must have the same composition as the core or of the envelope alloys. In another method of fabricating the metallic composite structures the envelope alloy is deposited as a coating onto a machined alloy core. Such coatings may be applied by well-known deposition techniques: torch spraying, plasma spraying, cathodic sputtering, electron beam evaporation or electroplating. The envelope alloy coating may be deposited directly as the desired composition, or may be formed by post diffusion of different layers of successively deposited components.

After the shaping step, the composite structures are usually submitted to a controlled oxidation in order to transform the alloy of the envelope into a ceramic envelope. The oxidation step is carried out at a temperature lower than the melting point of the alloys. The oxidation temperature may be chosen such that the oxidation rate is about 0.005 to 0.010 mm per hour. The oxidation may be conducted in air or in controlled oxygen atmosphere, preferably at about 1000° C. for 10–24 hours to fully oxidise the copper.

For some substrate alloys it has been observed that a substrate component, in particular iron, or generally any component metal present in the substrate alloy but not present in the coating alloy, may diffuse into the ceramic oxide coating during the oxidation phase before oxidation is complete, or diffusion may be induced by heating in an inert atmosphere prior to oxidation. Diffusion of a coating component into the substrate can also take place.

Preferably, after the oxidation step the composite is heated in air at about 1000° C. for about 100 to 200 hours. This annealing or ageing step improves the uniformity of the composition and the structure of the formed ceramic phase.

The ceramic phase may advantageously be a solid solution of $(M_xCu_{l-x})\ O_y$, M being at least one of the principal components of the envelope alloy. Because of the presence of the copper oxide matrix which plays the role of oxygen transfer agent and binder during the oxidation step, the envelope alloy can be transformed totally into a coherent ceramic phase. The stresses which usually occur due to the volume increase during the transformation of the envelope alloy are absorbed by the plasticity of the copper oxide phase which reduces the risks of cracking of the ceramic layer. When the envelope alloy is completely transformed into a ceramic phase, the surface of the refractory alloy of the core of the structure reacts with oxygen, and forms a $Cr_2O_3$-based oxide layer which plays the role of oxygen barrier impeding further oxidation of the core. Because of the similar chemical stabilities of the constituents of the ceramic phase formed from the copper based alloy and the chromium oxide phase of the core, there is no incompatibility between the ceramic envelope and the metallic core, even at high temperatures. The limited interdiffusion between the chromium oxide based layer at the metallic core surface, and the copper oxide based or other ceramic envelope may confer to the latter a good adherence on the metallic core.

The presence of CuO confers to the ceramic envelope layer the characteristics of a semi-conductor. The electrical resistivity of CuO is about $10^{-2}$ to $10^{-1}$ ohm.cm at 1000° C. and this is reduced by a factor of about 100 by the presence of a second metal oxide such as NiO or $MnO_2$. The electrical conductivity of this ceramic phase may be further improved by incorporating a soluble noble metal into the copper alloy before the oxidation step. The soluble noble metals may be for example palladium, platinum or gold in an amount of up to 20–30% by weight. In such a case, a cermet envelope may be obtained, with a noble metal network uniformly distributed in the ceramic matrix. Another way to improve the electrical conductivity of the ceramic envelope may be the introduction of a dopant of the second metal oxide phase; for example, the NiO of the ceramic phase prepared from Ni-Cu alloys may be doped by lithium.

By formation of a solid solution with stable oxides such as NiO or $MnO_2$, the copper oxide based ceramic envelope has a good stability under corrosive conditions at high temperatures. Furthermore, after the ageing step, the composition of the ceramic phase may be more uniform, with large grain sizes, whereby the risk of grain boundary corrosion is strongly decreased.

The described non-consumable anodes can be used in molten salt electrolysis at temperatures in the range between 400–1000° C. as a completely prefabricated anode or, in accordance with the claimed method, as an anode substrate for in-situ maintained anode coatings based on cerium oxyfluoride, used in aluminum electrowinning.

The application of the anodes as substrate for cerium oxyfluoride coatings is particularly advantageous because the cerium oxyfluoride coating can interpenetrate with the copper-oxide based or other ceramic coatings providing excellent adhesion. In addition, formation of the cerium oxyfluoride coating in situ from molten cryolite containing cerium species takes place with no or minimal corrosion of the substrate and a high quality adherent deposit is obtained.

For this application as anode substrate, it is understood that the metal being electrowon will necessarily be more noble than the cerium ($Ce3+$) dissolved in the melt, so that the desired metal deposits at the cathode with no substantial cathodic deposition of cerium. Such metals can preferably be chosen from group IIIa (aluminum, gallium, indium, thallium), group IVb (titanium, zirconium, hafnium), group Vb (vanadium, niobium, tantalum) and group VIIb (manganese, rhenium).

In this method, the protective coating of eg cerium oxyfluoride may be electrodeposited on the anode substrate during an initial operating period in the molten electrolyte in the electrowinning cell, or the protective coating may be applied to the anode substrate prior to inserting the anode in the molten electrolyte in the cell. Preferably, electrolysis is carried out in a fluoride-based melt containing a dissolved oxide of the metal to be won and at least one cerium compound, the protective coating being predominantly a fluorine-containing cerium oxycompound. For example the coating may consist essentially of fluorine-containing ceric oxide with only traces of additives.

Advantages of of the invention over the prior art will now be demonstrated by the following examples.

EXAMPLE 1

Oxidation of a copper - based alloy

A tube of Monel 400 ™ alloy (63% Ni - 2% Fe - 2.5% Mn - balance Cu) of 10 mm diameter, 50 mm length, with a wall thickness of 1 mm, is introduced in a furnace heated at 1000° C., in air. After 400 hours of oxidation, the tube is totally transformed into a ceramic structure of about 12 mm diameter and 52 mm length, with a wall thickness of 1.25 mm. Under optical microscope, the resulting ceramic presents a monophase structure, with large grain sizes of about 200–500 micrometers. Copper and nickel mappings, made by Scanning Electron Microscopy, show a very uniform distribution of these two Components; no segregation of composition at the grain boundaries is observed. Electrical conductivity measurements of a sample of the resulting ceramic show the following results:

| TEMPERATURE (°C.) | RESISTIVITY (Ohm · cm) |
|---|---|
| 400 | 8.30 |
| 700 | 3.10 |
| 850 | 0.42 |
| 925 | 0.12 |
| 1000 | 0.08 |

EXAMPLE 2

Annealing of an oxidised copper - based alloy

Two tubes of Monel 400 ™ oxidised at 1000° C. in air as described in Example 1 are subjected to further annealing in air at 1000° C. After 65 hours, one tube is removed from the furnace, cooled to room temperature, and the cross section is examined by optical microscope. The total thickness of the tube wall is already oxidised, and transformed into a monophase ceramic structure, but the grain joints are rather loose, and a copper rich phase is observed at the grain boundaries. After 250 hours, the second tube sample is removed from the furnace and cooled to room temperature. The cross section is observed by optical microscope. Increasing the ageing step from 65 hours to 250 hours produces an improved, denser structure of the ceramic phase. No visible grain boundary composition zone is observed.

Examples 1 and 2 thus show that these copper-based alloys, when oxidised and annealed, display interesting characteristics. However, as will be demonstrated by testing (Example 5) these alloys alone are inadequate for use as an electrode substrate in aluminum production.

EXAMPLES 3*a*, 3*b* and 3*c*

Production of composites according to the invention

EXAMPLE 3*a*

A tube with a semi-spherical end, of 10 mm outer diameter and 50 mm of length, is machined from a bar of Monel 400 ™. The tube wall thickness is 1 mm. A bar of Inconel ™ (type 600: 76% Ni - 15.5% Cr - 8% Fe) of 8 mm diameter and 500 mm length is inserted mechanically in the Monel tube. The exposed part of the Inconel bar above the Monel envelope is protected by an alumina sleeve. The structure is placed in a furnace and heated, in air, from room temperature to 1000° C. during 5 hours. The furnace temperature is kept constant at 1000° C. during 250 hours; then the furnace is cooled to room temperature at a rate of about 50° C. per hour. Optical microscope examination of the cross section of the final structure shows a good interface between the Inconel core and the formed ceramic envelope. Some microcracks are observed at the interface zone of the ceramic phase, but no cracks are formed in the outer zones. The Inconel core surfaces are partially oxidised to a depth of about 60 to 75 micron. The chromium oxide based layer formed at the Inconel surface layer interpenetrates the oxidised Monel ceramic phase and insures a good adherence between the metallic core and the ceramic envelope.

EXAMPLE 3*b*

A cylindrical structure with a semi-spherical end, of 32 mm diameter and 100 mm length, is machined from a rod of Inconel-600 ™ (Typical composition: 76% Ni - 15.5% Cr - 8% Fe + minor components (maximum %): carbon (0.15%), Manganese (1%), Sulfur (0.015%), Silicon (0.5%), Copper (0.5%)). The surface of the Inconel structure is then sand blasted and cleaned successively in a hot alkali solution and in acetone in order to remove traces of oxides and greases. After the cleaning step, the structure is coated successively with a layer of 80 micrometers of nickel and 20 micrometers of copper, by electrodeposition from respectively nickel sulfamate and copper sulfate baths. The coated structure is heated in an inert atmosphere argon containing 7% hydrogen) at 500° C. for 10 hours, then the temperature is increased successively to 1000° C. for 24 hours and 1100° C. for 48 hours. The heating rate is controlled at 300° C./hour. After the thermal diffusion step, the structure is allowed to cool to room temperature. The interdiffusion between the nickel and copper layers is complete and the Inconel structure is covered by an envelope Coating of Ni-Cu alloy of about 100 micrometers. Analysis of the resulting envelope coating gave the following values for the principal components:

| | Coating Surface | Coating-Substrate interdiffusion zone |
|---|---|---|
| Ni (w %) | 71.8 | 82.8–81.2 |
| Cu (w %) | 26.5 | 11.5–0.7 |
| Cr (w %) | 1.0 | 3.6–12.0 |
| Fe (w %) | 0.7 | 2.1–6.1 |

After the diffusion step, the coated Inconel structure is oxidised in air at 1000° C. during 24 hours. The heating and cooling rates of the oxidation step are respectively 300° C./hour and 100° C./hour. After the oxidation step, the Ni-Cu envelope coating is transformed into a black, uniform ceramic coating with an excellent adherence on the Inconel core. Examination of a cross-section of the final structure shows a monophase nickel/-copper oxide outer coating of about 120 micrometers and an inner layer of $Cr_2O_3$ of 5 to 10 micrometers. The inside of the Inconel core remained in the initial metallic state without any trace of internal oxidation.

EXAMPLE 3*c*

A cylindrical structure with a semi-spherical end, of 16 mm diameter and 50 mm length, is machined from a rod of ferritic stainless steel (Typical composition: 17% Cr, 0.05% C, 82.5% Fe). The structure is successively coated with 160 micrometers Ni and 40 micrometers Cu as described in Example 3*b*, followed by a diffusion step in an Argon-7% Hydrogen atmosphere at 500° C. for 10 hours, at 1000° C. for 24 hours and 1100° C. for 24 hours. Analysis of the resulting envelope coating gave the following values for the principal components:

| | Coating surface | Coating-Substrate interdiffusion zone |
|---|---|---|
| Ni (w %) | 61.0 | 39.4–2.1 |
| Cu (w %) | 29.8 | 0.2–0 |
| Cr (w %) | 1.7 | 9.2–16.0 |
| Fe (w %) | 7.5 | 51.2–81.9 |

After the diffusion step, the ferritic stainless steel structure and the final coating is oxidised in air, at 1000° C. during 24 hours as described in Example 3*b*. After the oxidation step, the envelope coating is transformed into a black, uniform ceramic coating. A cross section of the final structure shows a multi-layer ceramic coatings composed of:

- an uniform nickel/copper oxide outer coating of about 150 micrometers, which contains small precipitates of nickel/iron oxide;
- an intermediate nickel/iron oxide coating of about 50 micrometer, which is identified as a $NiFe_2O_4$ phase; and
- a composite metal-oxide layer of 25 to 50 micrometers followed by a continuous $Cr_2O_3$ layer of 2 to 5 micrometers.

The inside of the ferritic stainless steel core remained in the initial metallic state.

EXAMPLE 4

Testing of a composite according to the invention

A composite ceramic-metal structure prepared from a Monel 400-Inconel 600 structure, as described in Example 3*a*, is used as anode in an aluminum electrowinning test, using an alumina crucible as the electrolysis cell and a titanium diboride disk as cathode. The electrolyte is composed of a mixture of cryolite ($Na_3AlF_6$) with 10% $Al_2O_3$ and 1% $CeF_3$ added. The operating temperature is maintained at 970–980° C., and a constant anodic current density of 0.4 A/cm$^2$ is applied. After 60 hours of electrolysis, the anode is removed from the cell for analysis. The immersed anode surface is uniformly covered by a blue coating of cerium oxyfluoride formed during the electrolysis. No apparent corrosion of the oxidised Monel ceramic envelope is observed, even at the melt line non-covered by the coating. The cross section of the anode shows successively the Inconel core, the ceramic envelope and a cerium oxyfluoride coating layer about 15 mm thick. Because of interpenetration at the interfaces of the metal/ceramic and ceramic/coating, the adherence between the layers is excellent. The chemical and electrochemical stability of the anode is proven by the low levels of nickel and copper contaminations in the aluminum formed at the cathode, which are respectively 200 and 1000 ppm. These values are considerably lower than those obtained in comparable testing with a ceramic substrate, as demonstrated by comparative Example 5.

EXAMPLE 5

Comparative testing of oxidised/annealed copper based alloy

The ceramic tube formed by the oxidation/annealing of Monel 400 ™ in Example 2 is afterwards used as an anode in an aluminum electrowinning test following the same procedure as in Example 4. After 24 hours of electrolysis, the anode is removed from the cell for analysis. A blue coating of oxyfluoride is partially formed on the ceramic tube, occupying about 1 cm of the immediate length below the melt line. No coating, but a corrosion of the ceramic substrate, is observed at the lower parts of the anode. The contamination of the aluminum formed at the cathode was not measured; however it is estimated that this contamination is about 10–50 times the value reported in Example 4. This poor result is explained by the low electrical conductivity of the ceramic tube. In the absence of the metallic core, only a limited part of the tube below the melt line is polarised with formation of the coating. The lower immersed parts of the anode, non polarised, are exposed to chemical attack by cryolite. The tested material alone is thus not adequate as anode substrate for a cerium oxyfluoride based coating. It is hence established that the composite material according to the invention (i.e. the material of Example 3*a* as tested in Example 4) is technically greatly superior to the simple oxidised/annealed copper oxide based alloy.

EXAMPLE 6

Testing of a composite material according to the invention

Two cylindrical structures of Inconel-600 ™ are machined as described in Example 3*b* and coated with a nickel-copper alloy layer of 250–300 micrometers by flame spraying a 70 w% Ni - 30 w% Cu alloy powder. After the coating step, the structures are connected parallel to two ferritic steel conductor bars of an anode support system. The conductor bars are protected by alumina sleeves. The coated Inconel anodes are then oxidised at 1000° C. in air. After 24 hours of oxidation the anodes are transfered immediately to an aluminum electrowinning cell made of a graphite crucible. The crucible has vertical walls masked by an alumina ring and the bottom is polarized cathodically. The electrolyte is Composed of a mixture of cryolite ($Na_3AlF_6$) with 8.3% $AlF_3$, 8.0% $Al_2O_3$ and 1.4% $CeO_2$ added. The operating temperature is maintained at 970–980° C. The total immersion height of the two nickel/copper oxide coated Inconel electrodes is 45 mm from the semi-spherical bottom. The electrodes are then polarized anodically with a total current of 22.5A during 8 hours. Afterwards the total current is progressively increased up to 35A and maintained constant for 100 hours. During this second period of electrolysis, the cell voltage is in the range 3.95 to 4.00 volts. After 100 hours of operation at 35A, the two anodes are removed from the cell for examination. The immersed anode surface are uniformly covered by a blue coating of cerium oxyfluoride formed during the first electrolysis period. The black ceramic nickel/copper oxide coating of the non-immersed parts of the anode is covered by a crust formed by condensation of cryolite vapors over the liquid level. Examination of cross-sections of the anodes show successively:

- an outer cerium oxyfluoride coating of about 1.5 mm thickness;
- an intermediate nickel/copper oxide coating of 300–400 micrometers; and
- an inner $Cr_2O_3$ layer of 5 to 10 micrometers.

No sign of oxidation or degradation of the Inconel core is observed, except for some microscopic holes resulting from the preferential diffusion of chromium to the Inconel surface, forming the oxygen barrier $Cr_2O_3$ (Kirkendall porosity).

We claim:

1. A method of electrowinning a metal by electrolysis of a fluoride-based melt containing a dissolved oxide of the metal to be won using an anode immersed in the melt wherein the anode has a metal, alloy or cermet substrate and an operative anode surface which is a protective surface coating containing a fluorine-containing cerium oxycompound, the protective coating being preserved by maintaining in the melt a suitable concentration of at least one cerium compound, characterized by using an using an anode comprising:

(a) an electronically conductive oxygen barrier layer on the surface of the metal, alloy or cermet substrate, wherein the oxygen barrier layer is selected from the group consisting of a chromium oxide containing layer; a layer containing at least one of platinum, palladium and gold; platinum-zirconium alloys; and nickel-aluminum alloys, and wherein the anode further comprises:

(b) a pre-applied oxide ceramic layer between the protective coating and the oxygen barrier layer, said oxide ceramic layer serving as anchorage for the protective coating, wherein the oxide ceramic layer is selected from the group consisting of copper oxide in solid solution with at least one further oxide; nickel ferrite; copper oxide and nickel ferrite; doped, non-stoichiometric or partially substituted spinels; and rare earth metal oxides or oxyfluorides.

2. The method of claim 1, wherein the protective coating was electrodeposited on the anode substrate during an initial operating period in said melt.

3. The method of claim 1, wherein the protective coating was applied to the anode substrate prior to inserting the anode into the melt.

4. The method of claim 1, wherein the protective coating consists essentially of fluorine-containing ceric oxide.

5. The method of claim 1, wherein the oxygen barrier layer is an integral oxide film composed of a component or components of the metal, alloy or cermet substrate.

6. The method of claim 1, wherein the substrate is an alloy comprising 10 to 30% by weight of chromium, 55 to 90% of nickel, cobalt and/or iron and up to 15% of aluminum, hafnium, molybdenum, niobium, silicon, tantalum, titanium, tungsten, vanadium, yttrium and zirconium, the oxygen-barrier layer comprising chromium oxide.

7. A method according to claim 1, wherein the oxygen barrier layer is a separate layer applied to the surface of the metal, alloy or cermet substrate.

8. The method of claim 1, wherein the oxide ceramic layer comprises copper oxide in solid solution with an oxide of nickel or an oxide of manganese.

9. An anode for metal electrowinning from molten salt electrolytes comprising a metal, alloy or cermet substrate carrying a protective operative anode surface which in use is preserved by maintaining in the melt a suitable concentration of at least one cerium compound, characterized by there being an electronically conductive oxygen barrier layer on the surface of the metal, alloy or cermet substrate, wherein the oxygen barrier layer is selected from the group consisting of a chromium oxide containing layer; a layer containing at least one of platinum, palladium and gold; platinum-zirconium alloys; and nickel-aluminum alloys, wherein the anode further comprises a pre-applied oxide ceramic layer between the protective coating and the oxygen barrier layer, said oxide ceramic layer service as anchorage for the protective coating, said oxide ceramic layer being selected from the group consisting of copper oxide in solid solution with at least one further oxide; nickel ferrite; copper oxide and nickel ferrite; doped, nonstoichiometric or partially substituted spinels; and rare earth metal oxides or oxyfluorides.

10. The anode of claim 9, wherein the oxygen barrier layer is an integral oxide film composed of a component or components of the metal, alloy or cermet substrate.

11. The anode of claim 9, wherein the substrate is an alloy comprising 10 to 30% by weight of chromium, 55 to 90% of nickel, cobalt and/or iron and up to 15% of aluminum, hafnium, molybdenum, niobium, silicon, tantalum, titanium, tungsten, vanadium, yttrium and zirconium, the oxygen-barrier layer comprising chromium oxide.

12. The anode of claim 9, wherein the oxygen barrier layer is a separate layer applied to the surface of the metal, alloy or cermet substrate.

13. The anode of claim 9, wherein the oxide ceramic layer comprises copper oxide in solid solution with an oxide of nickel or an oxide of manganese.

* * * * *